US006394225B1

(12) United States Patent
Yasuda

(10) Patent No.: US 6,394,225 B1
(45) Date of Patent: May 28, 2002

(54) MUFFLER STRUCTURE

(75) Inventor: Kazuhiro Yasuda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/691,214

(22) Filed: Oct. 19, 2000

(30) Foreign Application Priority Data

Oct. 19, 1999 (JP) ..... 11-297484

(51) Int. Cl.[7] ..... F01N 1/24

(52) U.S. Cl. ..... 181/256; 181/265; 181/272; 181/282

(58) Field of Search ..... 181/252, 255, 181/256, 264, 265, 269, 272, 282; 29/890.08

(56) References Cited

U.S. PATENT DOCUMENTS 4,851,298 A * 7/1989 Fukuda ..... 181/227
5,718,045 A * 2/1998 Tsukahara et al. ..... 29/890.08
5,969,299 A * 10/1999 Yamaguchi et al. ..... 181/227
6,138,791 A * 10/2000 Zanzie ..... 181/252

* cited by examiner

*Primary Examiner*—Khanh Dang
(74) *Attorney, Agent, or Firm*—Birch, Stewart, Kolasch & Birch, LLP

(57) ABSTRACT

To provide a muffler structure capable of lowering muffler cost. A muffler structure is provided in which a sound absorbing material is laid on the inside surface of an outer tube. The sound absorbing material is retained by an inner tube made of a metal that is punched with a plurality of holes. The inner tube is divided into a plurality of expansion chambers. Exhaust gas from an engine is led into the fiat expansion chamber by an inlet pipe. The exhaust gas is discharged out after being supplied to the second and third expansion chambers in succession through the connecting pipes. In the muffler structure, the inner tube is made of an approximately flat metal that is punched with a plurality of holes by bending the metal into circular form until its opposite edges are butted to each other, and is fitted in the outer tube, with the butt portions not jointed, so that the butt portions will come behind the connecting pipe when viewed from the inlet pipe side.

14 Claims, 6 Drawing Sheets

FIG. 5
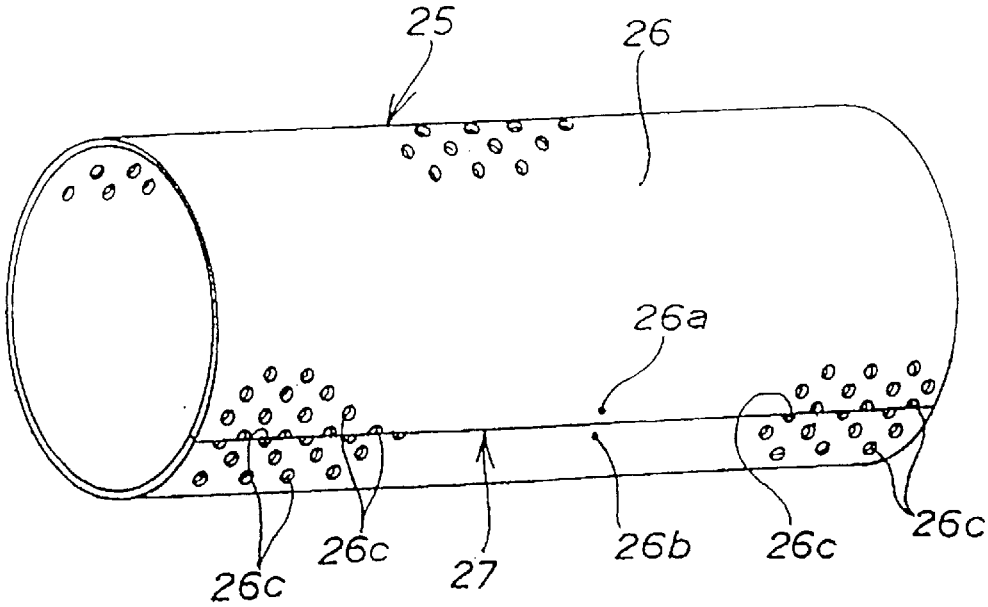
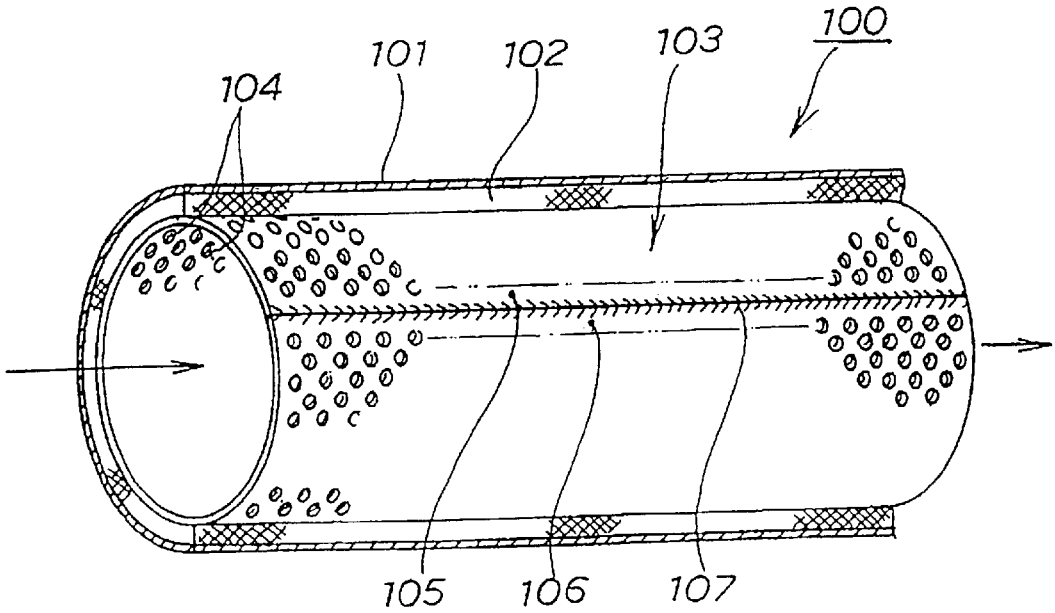
FIG. 6
*Prior Art*

MUFFLER STRUCTURE

BACKGROUND OF THE INVENTION

1. Field of the Invention

This invention relates to a muffler structure in which a sound absorbing material is arranged on the inside surface of an outer tube, and is retained with an inner tube made of a metal that is punched with a plurality of holes.

2. Description of Prior Art

Mufflers for motorcycles are of such a design that a sound absorbing material is installed between outer and inner tubes, and furthermore the interior of the inner tube is divided into a plurality of expansion chambers to deadening an exhaust sound. The muffler will be explained in detail by referring to the following drawing.

FIG. 6 is a schematic view of a conventional muffler structure. A sound absorbing material 102 (glass wool) is installed on the inside surface of an outer tube 101 of a muffler 100, and then is retained by an inner tube 103 made of a metal that is punched with a plurality of holes. Exhaust gas from the engine (not shown) is discharged out of the muffler 100 through the inner tube 103 as indicated by an arrow.

The inner tube 103 is formed of a punching metal as stated above, so that the glass wool 102 will appear out of punched holes 104 . . . made in the punching metal, thereby absorbing the exhaust sound.

In the inner tube 103, hot exhaust gases flow, and therefore the butt portion is jointed at both ends 105 and 106 in order that the inner tube 103 will not be opened at these ends 105 and 106 with exhaust heat. Since no clearance is formed at both ends 105 and 106, the glass wool 102 will never be scattered with the exhaust pressure.

To joint the butt portion 107, a welding operation is needed, resulting in an increase in time and manpower for manufacturing the inner tube 103. It is, therefore, hard to improve muffler productivity and to lower costs.

FIG. 7 is a developed view showing a punching metal for a conventional inner tube. The punching metal 110 has closed punched holes 104 . . . at both ends 105 and 106, so that the butt portion 107 may be welded properly at both ends 105 and 106 when forming the inner tube 104 (shown in FIG. 6).

Since the punched holes 104 . . . at both ends 105 and 105 of the metal that is punched with a plurality of holes 110 are needed to be closed, commercial punching metal is not usable for the inner tube 103 because the punched holes 104 . . . at both ends 105 and 106 of the commercial punching metal are left open.

Therefore, there is a necessity to manufacture special metal that is punched with a plurality of holes for the inner tube 103, which will be a factor responsible for an increase in the cost of the muffler.

SUMMARY AND OBJECTS OF THE INVENTION

It is, therefore, an object of the invention to provide a muffler structure capable of lowering the cost of the muffler.

In view of the above-described problems, this invention provides in a first aspect a muffler structure in which a sound absorbing material is laid on the inside surface of an outer tube; the sound absorbing material is retained by an inner tube made of a metal that is punched with a plurality of holes. The inner tube is separated into a plurality of expansion chambers. Exhaust gas from an engine is directed into one of the expansion chambers by an inlet pipe. The exhaust gas is discharged out after passing through the other expansion chambers one after another through a connecting pipe. In the muffler structure, the inner tube is made of an approximately flat punching metal by rolling until its opposite edges are butted to each other, and is fitted in the outer tube, with the butt portions not jointed, so that the butt portions will come behind one of the connecting pipes when viewed from the inlet pipe side.

The inner tube, therefore, is inserted into the outer tube in such a manner that the butt portion of the inner tube will come behind one of the connecting pipes when the butt portion of the inner tube is viewed from the inlet pipe side. Therefore the radiant heat of the inlet pipe can be shielded by the connecting pipe, thereby enabling to prevent the direct transfer of the radiant heat of the inlet pipe to the butt portion of the inner tube. Therefore, no large clearance will occur at the butt portion that is not joined.

Furthermore, because it is unnecessary to joint the butt portion of the punching metal, a metal that is punched with a plurality of holes having open punched holes at both end portions is usable. Therefore, a commercial punching metal may be used after cutting to a predetermined shape, whereby a metal that is punched with a plurality of holes for the inner tube is obtainable at a low cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is the second process drawing for fabricating the inner tube of the muffler structure pertaining to this invention;

FIG. 6 is a schematic view of a conventional muffler structure; and

DETAILED DESCRIPTION OF TIE PREFERRED EMBODIMENTS

Figure 1:
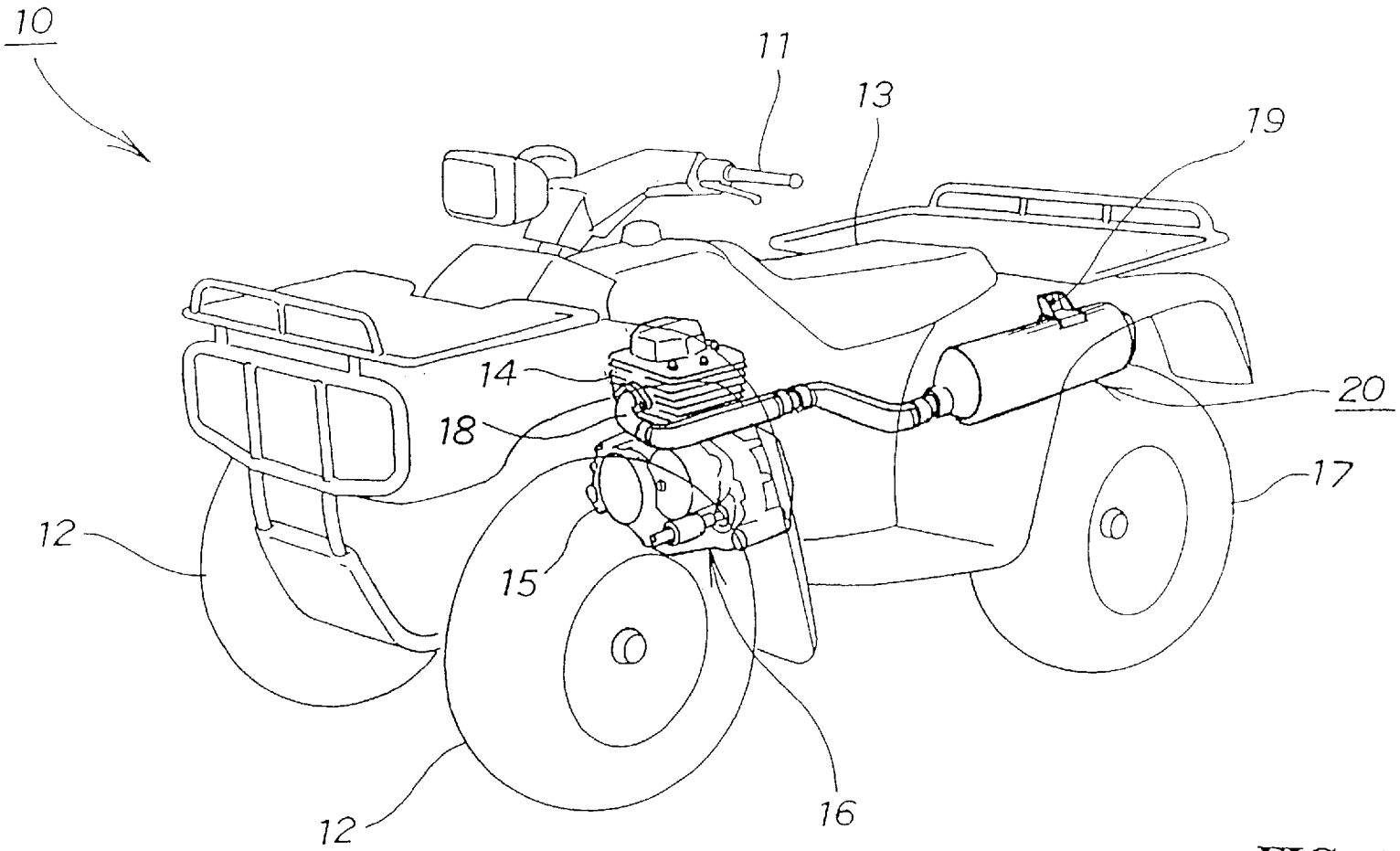
FIG. 1 is a perspective view showing an all-terrain vehicle using a muffler structure pertaining to this invention.

A preferred embodiment of a muffler structure according to this invention will be explained with reference to the accompanying drawings wherein FIG. 1 is a perspective view of an all-terrain vehicle (ATV) equipped with the muffler structure of the present invention.

The ATV 10 comprises a handlebar 11 rotatably mounted on a vehicle frame (not shown), front wheels 12, 12 which are steerable by the handlebar 11, a seat 13 attached on the upper part of the vehicle frame, a power unit 16 including an engine 14 mounted below the seat 13 and a transmission 15, rear wheels 17, 17 (the right rear wheel 17 is not shown) driven together with the front wheels 12, 12 by the power unit 16, an exhaust pipe 18 extends rearwardly from the front of the engine 14. A muffler structure 20 is connected to the rear part of the exhaust pipe 18 and mounted by a mounting bracket 19 on the vehicle frame.

The AMV 10 is a buggy having a compact, light-weight vehicle body, which is easy to operate to be able to make quick, sharp turns. This vehicle, therefore, is used especially as an off-road vehicle suitable for moving and leisure purposes, for example for use in farming, livestock farming, hunting, safety guard, etc.

Figure 2:
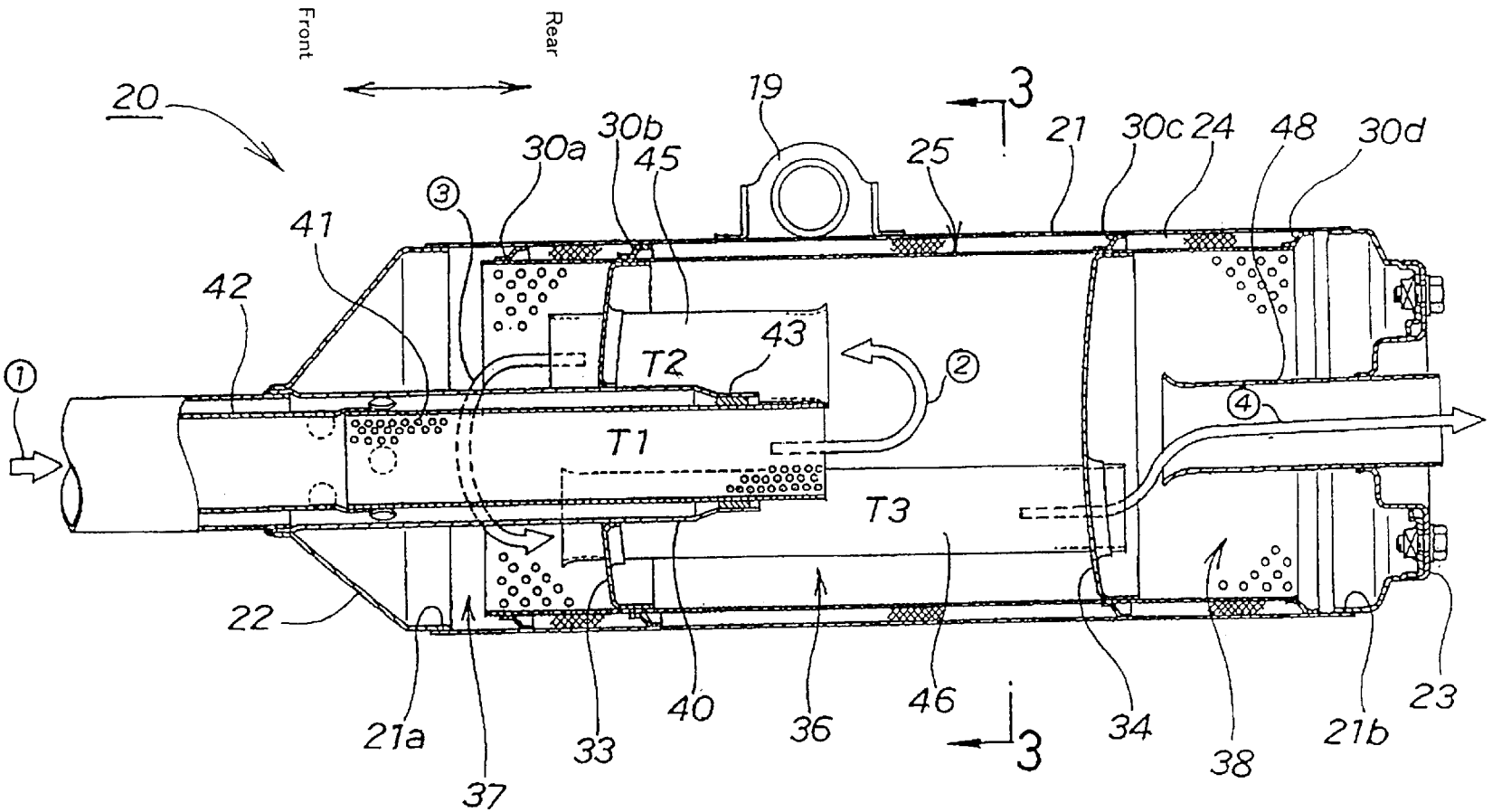
FIG. 2 is a sectional view of the muffler structure pertaining to this invention.

FIG. 2 is a sectional view of a muffler structure pertaining to present invention. The muffler structure 20 is constructed wherein a sound absorbing material 24 is laid on the inside surface of an outer tube 21. The sound absorbing material 24 is retained by an inner tube 25 made of a metal that is punched with a plurality of holes.

Front and rear openings 21*b* and 21*b* of the outer tube 21 are closed with front and rear cover members 22 and 23. The inner tube 25 is divided by front and rear partition plates 33 and 34 into first to third expansion chambers 36, 37 and 38. Exhaust gas from the engine 14 (shown in FIG. 1) is directed into the first expansion chamber 36 through an inlet pipe 40. The exhaust gas is further supplied to the second and third expansion chambers 37 and 38 in succession through first and second connecting pipes 45 and 46. The exhaust gas is then discharged out of the outer tube 21 through a tail pipe 48.

The outer tube 21 is made of an approximately flat plate, which is bent into a tubular form and mutually butt-jointed at the opposite edges, and then fitted with the mounting bracket 19 (see FIG. 1 also) on the outside surface. The mounting bracket 19 is a member for mounting the muffler structure 20 to the vehicle frame.

The front cover member 22 is a member attached by welding the outer periphery to the front end of the outer tube 21, to support the inlet pipe 40 that extends into the inner tube 25.

The rear cover member 23 is a member joined by welding the outer periphery to the rear end of the outer tube 21 and connected with the tail pipe 48.

The sound absorbing material 24 is a member made of a heat-resisting fiber such as glass wool for absorbing exhaust sound.

The inner tube 25 is attached to the inside surface of the outer tube 21 by the first to fourth mounting rings 30*a*, 30*b*, 30*c* and 30*d*, to thereby retain the sound absorbing material 24 on the inside surface of the outer tube 21.

The inner tube 25 will be explained in detail by referring to FIGS. 3 to 5. The front partition plate 33 is a partition plate for dividing the inner tube 25 by joining its outer periphery by welding to the front part of the inner tube 25, also serving as a support member for supporting the inlet pipe 40 and the first and second connecting pipes 45 and 46.

The rear partition plate 34 is a partition plate for dividing the inner tube 25 by joining its outer periphery by welding to the rear part of the inner tube 25 and also serves as a member for supporting the second connecting pipe 46.

The front and rear partition plates 33 and 34 are installed at a predetermined spacing, thereby dividing the inner tube 25 into the first to third expansion chambers 36, 37 and 28.

The inlet pipe 40 is connected at the front end to the exhaust pipe 18 (shown in FIG. 1) and is provided with a heat pipe 41 (a tubular body containing a catalyst) inserted through an inner pipe 42 and a heat-resisting elastic material 43.

The first connecting pipe 45 is inserted through the front partition plate 33 to connect the first expansion chamber 36 with the second expansion chamber 37, being routed in parallel with the inlet pipe 40.

The second connecting pipe 46 is inserted at the front end through the front partition plate 33, and at the rear end through the rear partition plate 34, to thereby connect the second expansion chamber 37 with the third expansion chamber 38, being routed in parallel with the inlet pipe 40.

According to the muffler structure 20, the exhaust gas flows from the exhaust pipe 18 (shown in FIG. 1) into the inlet pipe 40 as indicated by the arrow 1 and, after cleaning the exhaust gas in the heat pipe 41, is directed into the first expansion chamber 36 as indicated by the arrow 2, then flows into the first connecting pipe 45 from the first expansion chamber 36.

The exhaust gas that has flowed into the first connecting pipe 45 flows into the second expansion chamber 37 as indicated by the arrow 3 and flows from the second expansion chamber 37 into the second connecting pipe 46. The exhaust gas that has flowed into the second connecting pipe 46 goes into the third expansion chamber 38 as indicated by the arrow 4 and then is discharged out from the third expansion chamber 38 through the tail pipe 48.

Here, T1 is the exhaust temperature of the exhaust gas flowing in the inlet pipe 40, T2 is the exhaust temperature of the exhaust gas flowing in the first connecting pipe 45, and T3 is the exhaust temperature of the exhaust gas flowing in the second connecting pipe 46. The relationship established between the exhaust temperatures is T1>T2>T3.

Figure 3:
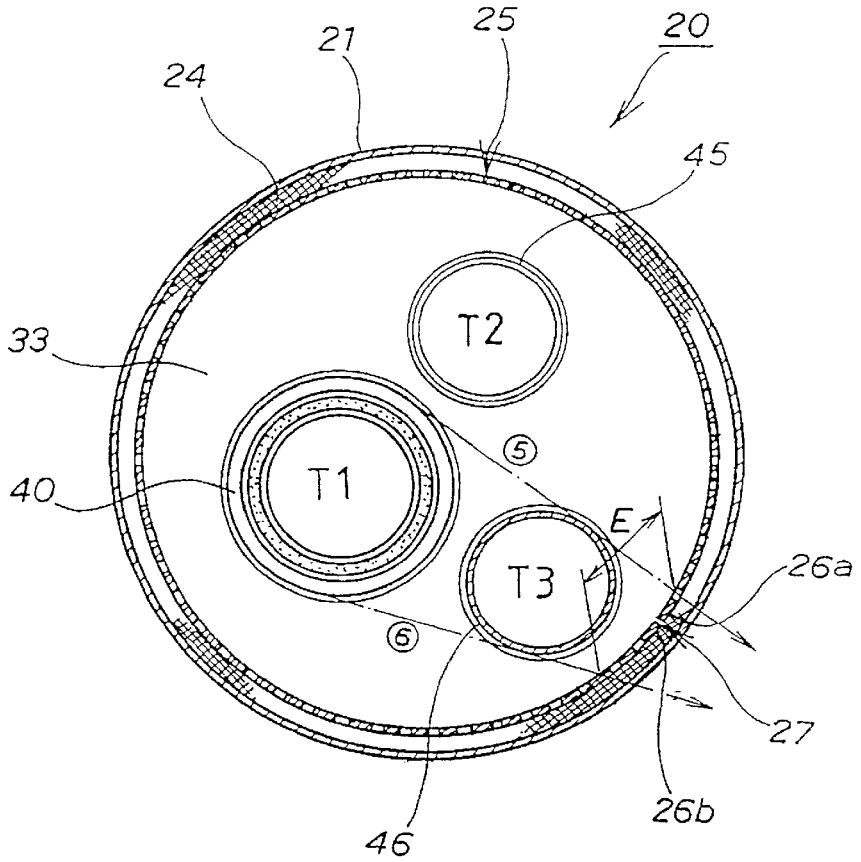
FIG. 3 is a sectional view taken along line 3—3 of FIG. 2.

FIG. 3 is a sectional view taken along line 3—3 of FIG. 2. The inner tube 25 is made of a flat plate-like metal 26 that is punched with a plurality of holes. As illustrated in FIGS. 4 and 5, the metal is rolled until its opposite edges 26*a* and 26*b* are butted to each other, and if fitted in the outer tube 21, with the butt portion 27 not jointed, so that the butt portion 27 will come in the range E behind the second connecting pipe 46 when viewed from the inlet pipe 40 side.

Figure 4:
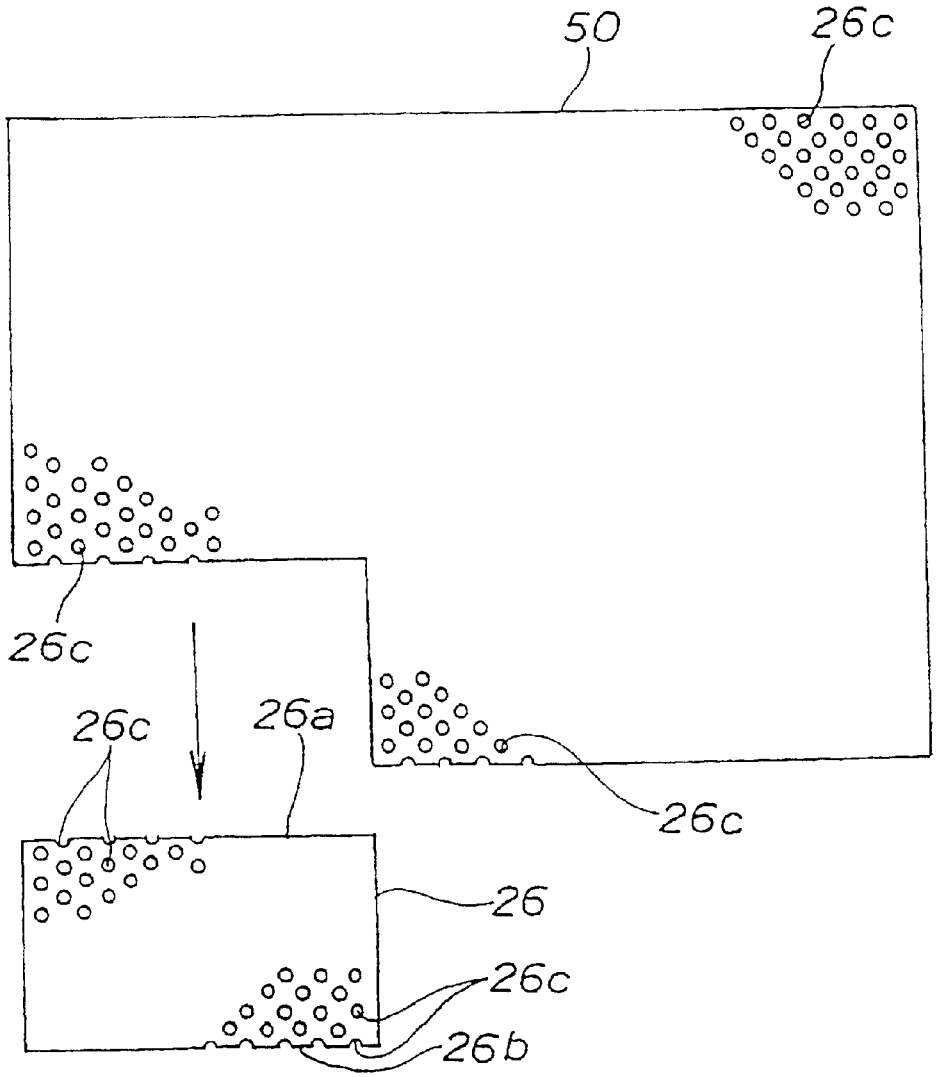
FIG. 4 is the first process drawing for fabricating an inner tube of the muffler structure pertaining to this invention.
Figure 7:
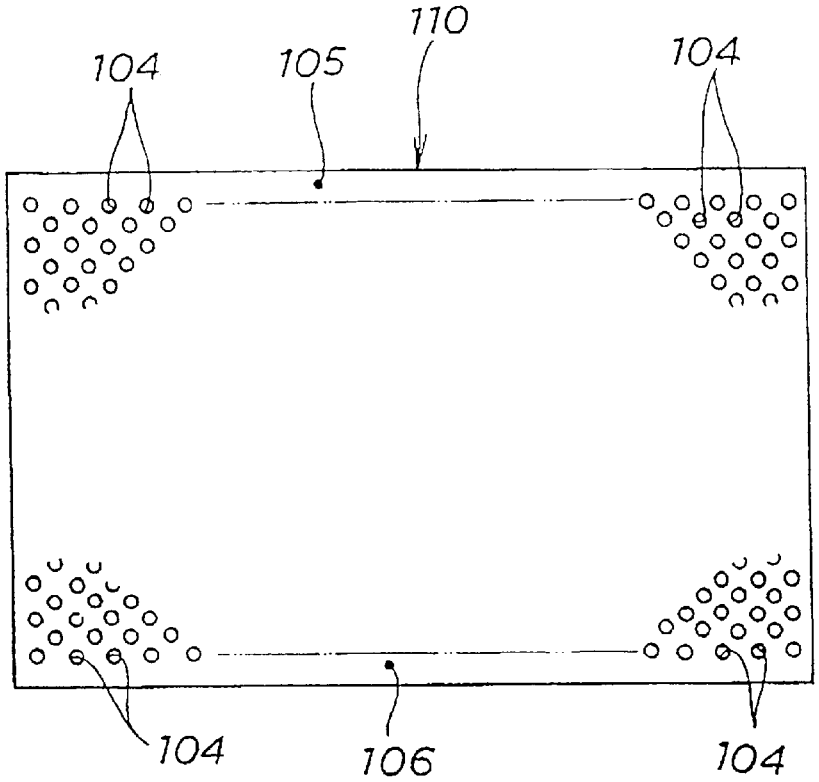
FIG. 7 Prior Art
FIG. 7 is a developed view of a punching metal for the conventional inner tube.

As illustrated in FIG. 4, T1 is the exhaust temperature of exhaust gas flowing in the inlet pipe 40, T2 is the exhaust temperature of exhaust gas flowing in the first connecting pipe 45, and T3 is the exhaust temperature of exhaust gas flowing in the second connecting pipe 46, establishing the relationship of T1>T2>T3. Therefore, in the range E behind the second connecting pipe 46, there exists the lowest exhaust temperature range in the inner tube 25.

Therefore, the radiant heat from the inlet pipe 40 can be shielded by the connecting pipe, and the exhaust temperature in the range behind the radiant heat, i.e., the range E behind the second connecting pipe 46, as indicated by the arrows and can be held relatively low. Therefore, the edge portions 26*a* and 26*b* will not be deformed with the exhaust heat. The butt portion 27, if not jointed, will not be opened with the exhaust heat. It is, therefore, possible to prevent the sound absorbing material 25 from scattering with an exhaust pressure.

Next, a process for fabricating the inner tube 25 will be explained. FIG. 4 is the first process drawing for fabricating the inner tube of the muffler structure pertaining to the present invention. The metal 26 that is punched with a plurality of holes for the inner tube 25 (shown in FIG. 2) is prepared by cutting off from a commercial standardized metal 50 that is punched with a plurality of holes.

The opposite edges 26*a* and 26*b* of the metal 26 that is punched with a plurality of holes, when rolled, are just mutually butted and need no welding. Therefore, punched holes 26*c* may be present in the opposite edge portions 26*a* and 26*b*. Besides since the punching metal for the inner tube is obtainable simply by cutting the commercial standardized metal 50 that is punched with a plurality of holes into a predetermined shape, a low-cost metal that is punched with a plurality of holes is obtainable.

FIG. 5 is the second process drawing for fabricating the inner tube of the muffler structure pertaining to the present invention. The opposite edges 26*a* and 26*b* of the punching metal 26, when rolled, are just mutually butted and need no welding of the butt portion 27 of the edge portions 26*a* and 26*b*.

In forming the inner tube 25, welding of the butt portion 27 can be dispensed with. The inner tube 25, therefore, can readily be fabricated without the welding process.

Back to FIG. 3, when the inner tube 25 is installed, the butt portion 27 of the edge portions 26*a* and 26*b* of the inner tube 25 is left non-jointed. The inner tube 25 is installed in the outer tube 21 in such a manner that the butt portion 27 will come within the range E behind the second connecting pipe 46 when viewed from the inlet pipe 40 side.

The inner tube 25, as shown in FIG. 2, has the first to fourth mounting rings 30*a*, 30*b*, 30*c* and 30*d* fitted on the outside surface and the front and rear partition plates 33 and 34 jointed on the inside surface. Therefore, the inner tube 25 is retained firmly from both the outside and inside surfaces.

Described in the above-described embodiment is the muffler structure 20 mounted on the ATV 10, which, however, is applicable also to other types of vehicles.

Further in the above-described embodiment, the inlet pipe 40 of the muffler structure 20 is connected to the exhaust pipe 18, and the inlet pipe 40 is set in the muffler, to thereby supply exhaust gas from the inlet pipe 40 into the muffler. The muffler structure may be of such a construction that the outlet side of the exhaust pipe is extended into the muffler, thereby supplying the exhaust gas into the muffler.

Furthermore, in the above embodiment, there has been explained an example of the muffler structure in which the inner tube 25 is inserted in such a manner that the butt portion 27 comes within the range E behind the second connecting pipe 46 when viewed from the inlet pipe 40 side. In this case, the butt portion 27 may be within the range behind the first connecting pipe 45 when viewed from the inlet pipe 40 side. However, since the exhaust temperature T2 in the first connecting pipe 45 is higher than the exhaust temperature T3 in the second connecting pipe 46, the temperature will be higher in the range behind the first connecting pipe 45 than in the range E behind the first connecting pipe 45.

The present invention having the above-described configuration has the following advantages. In the first aspect, the inner tube is fitted in the outer tube in such a position that the butt portion of the inner tube will come behind one of the connecting pipes when viewed from the inlet pipe side. Therefore, as the radiant heat of the inlet pipe can be shielded by the connecting pipe, it is possible to prevent direct heat transfer from the inlet pipe to the butt portion of the inner tube.

Therefore, since the ambient temperature of the butt portion can be held relatively low, there will occur no substantial gap in the butt portion if the butt portion is not jointed. Consequently, the butt portion jointing operation can be eliminated. This results in an improved productivity and a low muffler cost.

Furthermore, since jointing the butt portion of the metal that is punched with a plurality of holes is not required, a metal that is punched with a plurality of holes having open punched holes at both end portions can be used. Therefore, since it is possible to prepare the punching metal of a predetermined shape by cutting it from a commercial metal that is punched with a plurality of holes, the metal that is punched with a plurality of holes for the inner tube is obtainable at a low cost. That is, the muffler cost can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler structure in which a sound absorbing material is laid on the inside surface of an outer tube; said sound absorbing material is retained by an inner tube made of a metal that is punched with a plurality of holes; said inner tube is separated into a plurality of expansion chambers; and exhaust gas from an engine is directed into a first of said plurality of expansion chambers by an inlet pipe, being discharged out after being supplied to others of said plurality of expansion chambers one after another through at least one connecting pipe, said muffler structure comprises:

said inner tube is made of an approximately flat metal that is punched with a plurality of holes by bending the metal into a circular form until its opposite edges are butted to each other to form a butt portion that is not jointed, said inner tube being fitted in said outer tube, so that said butt portion is positioned behind said connecting pipe when viewed from said inlet pipe side.

2. The muffler structure according to claim 1, wherein said inlet pipe contains exhaust gas at a temperature that is higher relative to the temperature of the exhaust gas in said at least one connecting pipe.

3. The muffler structure according to claim 1, wherein said plurality of holes in said metal extend to the opposite edges of the metal that are butted to each other, wherein said metal is bent into said circular form.

4. The muffler structure according to claim 1, wherein a first connecting pipe and second connecting pipe are provided and said opposite edges of said metal that are butted to each other is positioned behind the second connecting pipe.

5. The muffler structure according to claim 1, wherein said inner tube extends a predetermined distance within said outer tube, and wherein said plurality of expansion chambers, formed by a front partition plate and a rear partition plate for dividing said outer tube and said inner tube, are a front chamber, a middle chamber and a rear chamber.

6. The muffler structure according to claim 5, wherein a first connecting pipe connects said middle chamber to said front chamber and a second connecting pipe connects said front chamber with said rear chamber.

7. The muffler structure according to claim 1, wherein said inlet pipe is constructed of a first predetermined diameter and said connecting pipe is constructed of a second predetermined diameter, said second predetermined diameter of said connecting pipe being smaller relative to said first predetermined diameter of said inlet pipe wherein tangent lines extending from an outer circumference of said inlet pipe to an outer circumference of said connecting pipe defme a area E disposed behind said connecting pipe for positioning said butt portions therebehind.

8. A muffler structure comprising:

an outer tube;

an inner tube formed of a metal that is punched with a plurality of holes;

a sound absorbing material is disposed between said outer tube and said inner tube;

a plurality of expansion chambers formed within said outer tube and said inner tube;

an inlet pipe for directing exhaust gas from an engine into a first of said plurality of expansion chambers; and at least one connecting pipe for discharging exhaust gas out of said first of said plurality of expansion chambers and into another of said plurality of expansion chambers;

said inner tube is constructed of an approximately flat metal that is punched with a plurality of holes by bending the metal into a circular form until its opposite edges are butted to each other to form a butt portion that is not jointed;

said inner tube being fitted into said outer tube, so that said butt portion will be positioned adjacent to said at least one connecting pipe so that said at least one connecting pipe is between said inlet pipe and said butt portion.

9. The muffler structure according to claim 8, wherein said inlet pipe contains exhaust gas at a temperature that is higher relative to the temperature of the exhaust gas in said at least one connecting pipe.

10. The muffler structure according to claim 8, wherein said plurality of holes in said metal extend to the opposite edges of the metal that are butted to each other, wherein said metal is bent into said circular form.

11. The muffler structure according to claim 8, wherein a first connecting pipe and second connecting pipe are provided and said first connecting pipe is disposed between said opposite edges of said metal that are butted to each other and said inlet pipe.

12. The muffler structure according to claim 8, wherein said inner tube extends a predetermined distance within said outer tube, and wherein said plurality of expansion chambers, formed by a front partition plate and a rear partition plate for dividing said outer tube and said inner tube, are a front chamber, a middle chamber and a rear chamber.

13. The muffler structure according to claim 12, wherein a first connecting pipe connects said middle chamber to said front chamber and a second connecting pipe connects said front chamber with said rear chamber.

14. The muffler structure according to claim 8, wherein said inlet pipe is constructed of a first predetermined diameter and said connecting pipe is constructed of a second predetermined diameter, said second predetermined diameter of said connecting pipe being smaller relative to said first predetermined diameter of said inlet pipe wherein tangent lines extending from an outer circumference of said inlet pipe to an outer circumference of said connecting pipe define a area E disposed behind said connecting pipe for positioning said butt portions therebehind.

* * * * *